US009743728B1

(12) United States Patent
McConnell

(10) Patent No.: US 9,743,728 B1
(45) Date of Patent: Aug. 29, 2017

(54) SUITCASE TRAVEL ORGANIZER

(71) Applicant: Bruce McConnell, Lincoln, CA (US)

(72) Inventor: Bruce McConnell, Lincoln, CA (US)

( * ) Notice: Subject to any disclaimer, the term of this patent is extended or adjusted under 35 U.S.C. 154(b) by 231 days.

(21) Appl. No.: 14/631,577

(22) Filed: Feb. 25, 2015

(51) Int. Cl.

| | |
|---|---|
| ***A45C 13/00*** | (2006.01) |
| ***A45C 5/06*** | (2006.01) |
| ***A45C 15/00*** | (2006.01) |
| ***A45C 5/14*** | (2006.01) |

(52) U.S. Cl.
CPC ..... *A45C 5/06* (2013.01); *A45C 5/14* (2013.01); *A45C 15/00* (2013.01)

(58) Field of Classification Search
CPC ..... A45C 5/06; A45C 5/14; A45C 15/00
See application file for complete search history.

(56) References Cited

U.S. PATENT DOCUMENTS 3,612,635 A * 10/1971 Uyeda ..... A01K 97/06 206/315.11
3,851,754 A * 12/1974 Jones ..... B65D 71/02 206/509
5,676,223 A 10/1997 Cunningham
5,967,270 A 10/1999 Shry
6,105,763 A 8/2000 Saetia
7,503,569 B2 * 3/2009 Duvigneau ..... A45C 7/0045 190/110
8,256,156 B1 * 9/2012 Burgoyne, Jr. ..... A01K 97/06 206/315.11
8,851,282 B2 * 10/2014 Brunner ..... B25H 3/028 206/372
2003/0106821 A1 * 6/2003 Bar-Erez ..... B25H 3/003 206/373
2006/0217699 A1 * 9/2006 Wang ..... A61B 18/1445 606/32

FOREIGN PATENT DOCUMENTS

| | | |
|---|---|---|
| CA | 2920616 | 12/2016 |
| DE | 20313481 U1 | 1/2004 |
| GB | 2494373 A | 3/2013 |

* cited by examiner

*Primary Examiner* — Tri Mai
(74) *Attorney, Agent, or Firm* — Stevenson IP, LLC

(57) ABSTRACT

The suitcase travel organizer provides a suitcase having an organizing case disposed atop. A top end width and top end depth of the suitcase equals a case width and a case depth. A plurality of various shaped and sized openings are disposed within a top side such that a traveler may carry differing items, including those such as drinks, lotion, media players, notepad, and writing implements. A handle disposed in the top side within a cutout provides for further item carry. The handle is flush with the top side.

8 Claims, 6 Drawing Sheets

SUITCASE TRAVEL ORGANIZER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of travel organizers are known in the prior art. Some fit within luggage items. Some are briefcase like. Many luggage items are cumbersome and a traveler is often burdened with handling the luggage item as well as other business-related items such as cell phones, notepads, computerized reading devices, drinks, lotions, and such. This is especially true of airport travel wherein extended waiting times are common. During such times, readily accessing wanted items is often inconvenient at the very best. What has been needed is a travel organizer that fits atop a luggage item, such as a rollaway piece of luggage, for example. Such an organizer therein provides for internal as well as external item carry. A desirable feature would be ready access to items carried externally. A further need is for such items to be separately organized. The suitcase travel organizer provides for these needs.

FIELD OF THE INVENTION

The present suitcase travel organizer relates to suitcases, and more especially to a suitcase travel organizer having an organizing case mounted atop.

SUMMARY OF THE INVENTION

The general purpose of the suitcase travel organizer, described subsequently in greater detail, is to provide a suitcase travel organizer that has many novel features that result in a suitcase travel organizer which is not anticipated, rendered obvious, suggested, or even implied by prior art, either alone or in combination thereof.

To accomplish this, the suitcase travel organizer comprises a substantially tetragonal luggage bag having a top end and a bottom end spaced apart from the top end. The top end has a top end width and a top end depth. The luggage bag has first side and a second side spaced apart from the first side. The luggage bag has a back side and an openable front side spaced apart from the back side. A telescopic handle is disposed on the back side. A pair of spaced apart wheels is disposed on the bottom end adjacent the back side.

An organizing case is fitted to the top end. The case has a top side and a bottom side spaced apart from the top side, a case width equal to the top end width and a case depth equal to the top end depth. Within the top side is a small circular opening having a first depth of approximately 1½ inches, a large circular opening, and a pair of adjacent writing implement openings. The top side also has a pair of writing implement openings, a ovular opening and a rectangular opening.

A cutout is disposed in the top side. A crossbar is disposed across a portion of the cutout. The crossbar is parallel with the case width and flush with the top side. The cutout selectively supports devices such as existing media players. The cutout is proximal the openable front side.

The large circular opening, the pair writing implement openings, the ovular opening, the rectangular opening, and the cutout each has a second depth of approximately 3 inches. In manufacturing, the organizing case is selectively removably affixed to the top end. Hook and loop is bonded to the top end and to the bottom side. Fasteners other than hook and loop are selectively chosen.

Thus has been broadly outlined the more important features of the present suitcase travel organizer so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
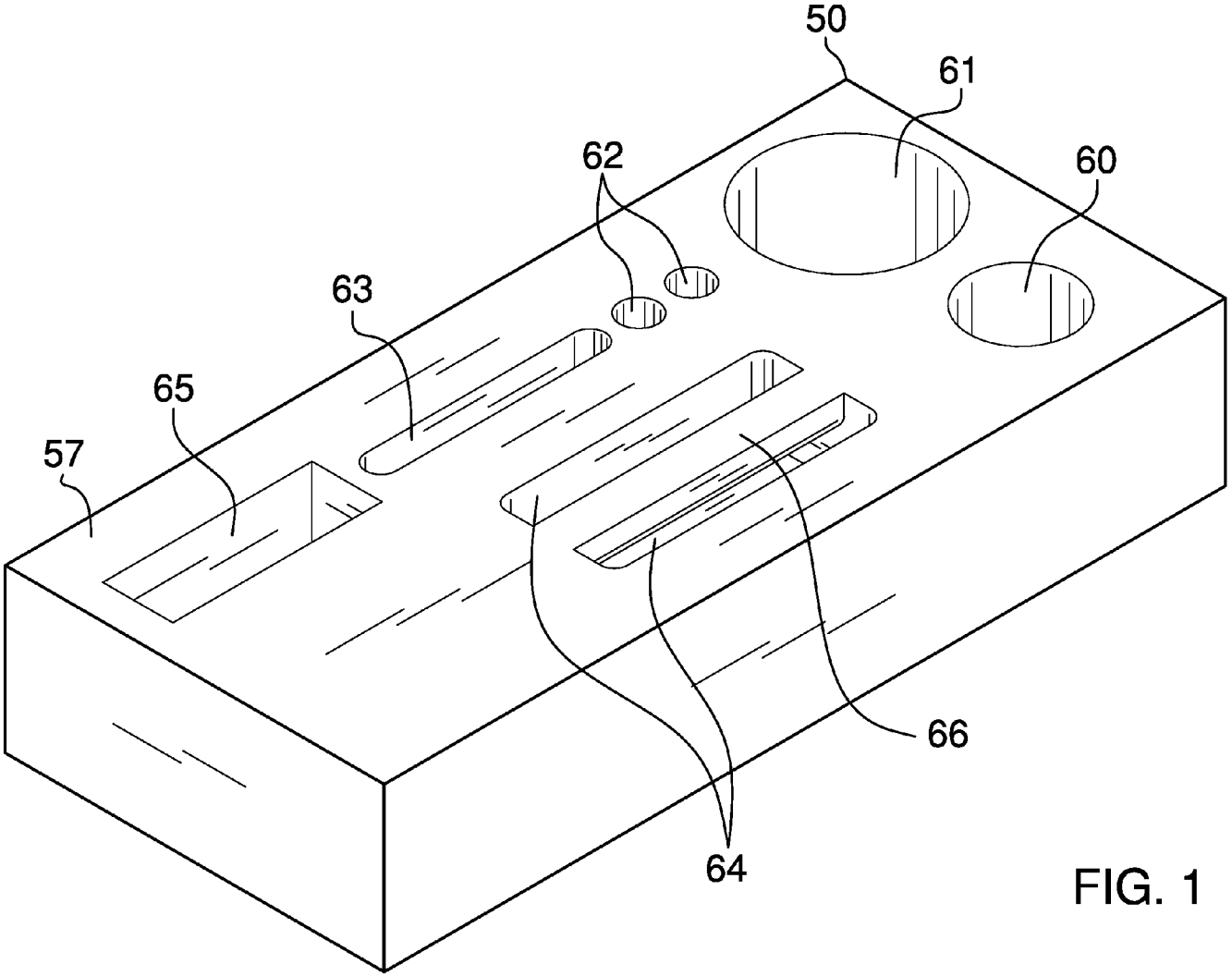
FIG. 1 is a perspective view of an organizer case.
Figure 2:
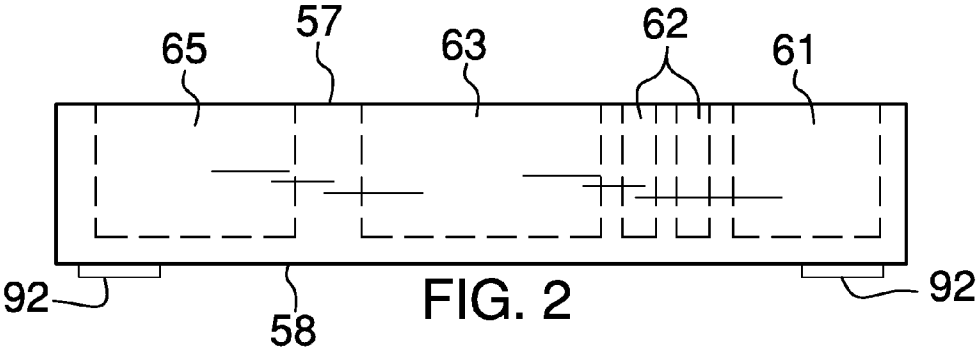
FIG. 2 is a detail view of the organizer case.
Figure 3:
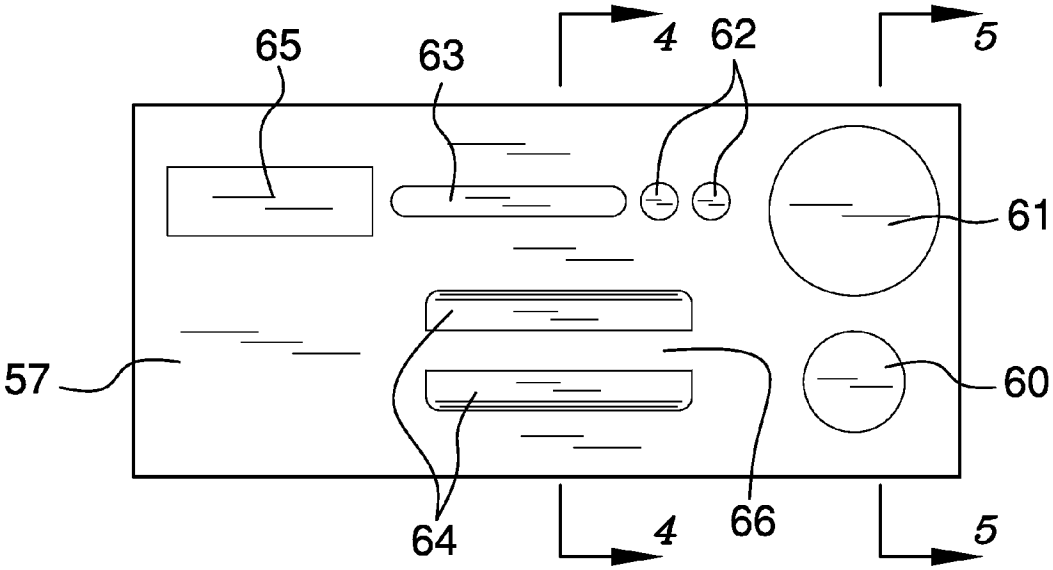
FIG. 3 is a top plan view of the organizer case.
Figure 4:
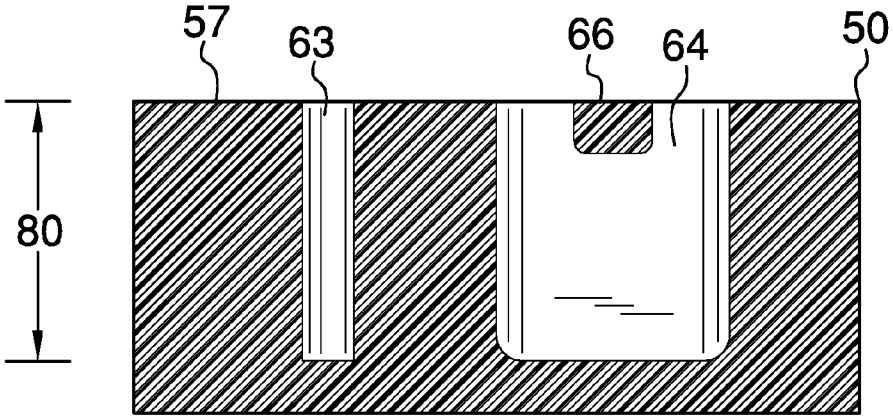
FIG. 4 is a cross sectional view of FIG. 3 taken along the line 4-4.
Figure 5:
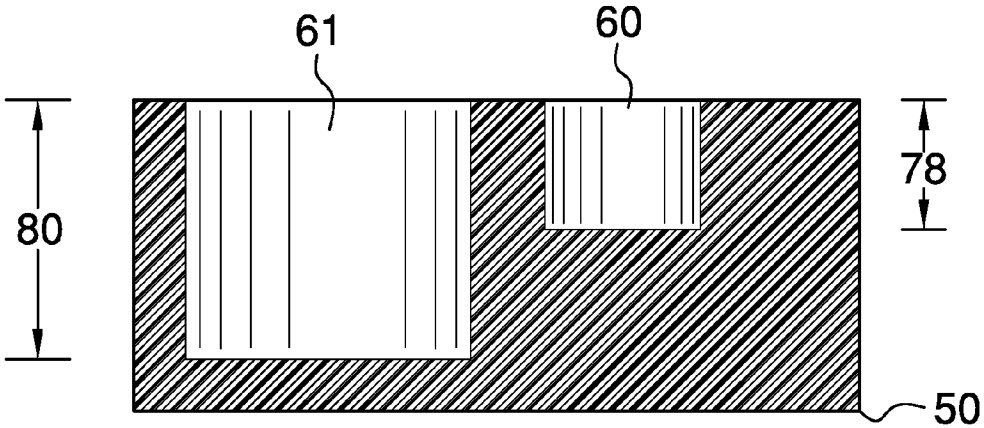
FIG. 5 is a cross sectional view of FIG. 3 taken along the line 5-5.
Figure 6:
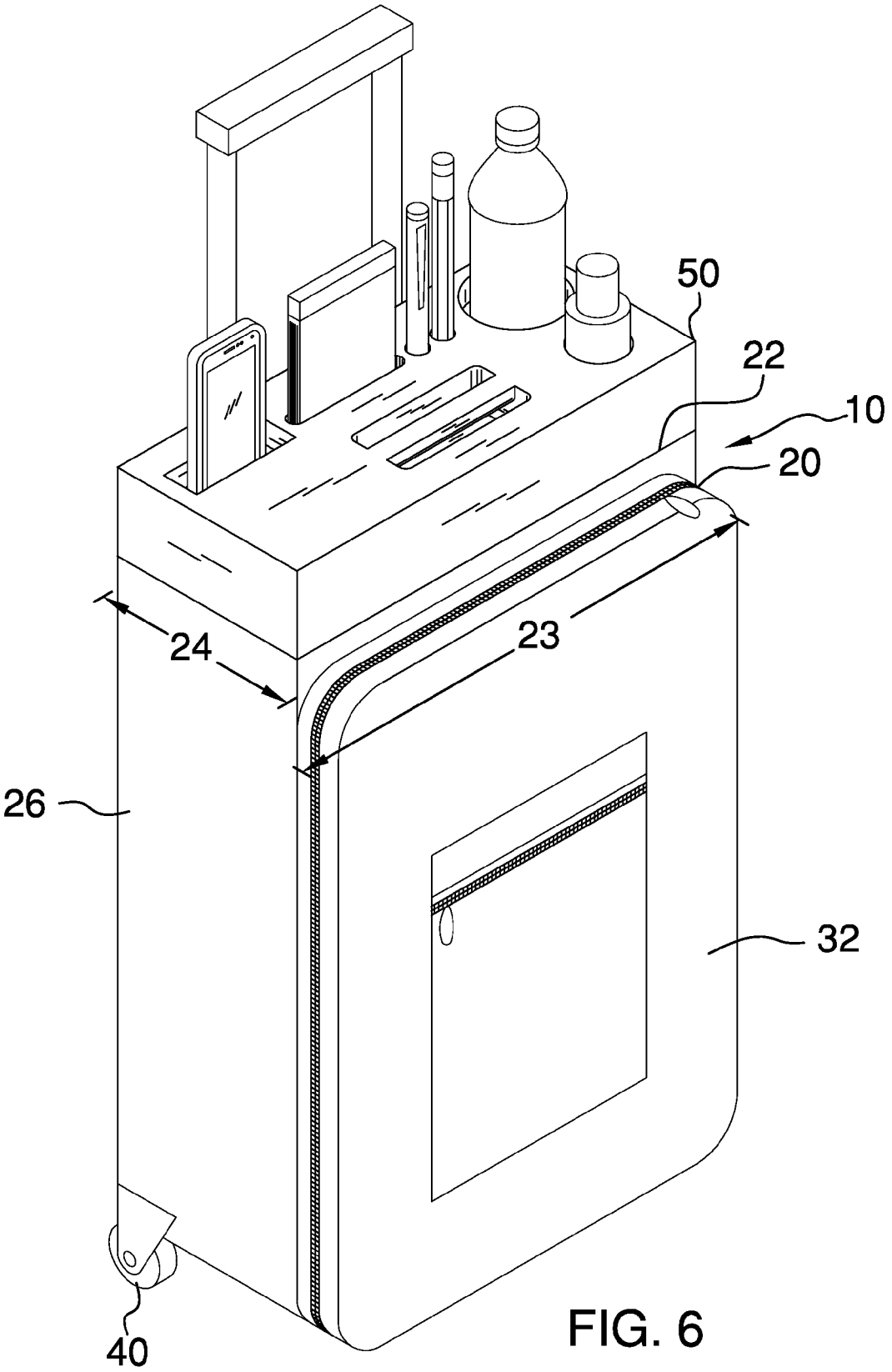
FIG. 6 is an in use perspective view of the organizer case affixed to a suitcase travel organizer.
Figure 7:
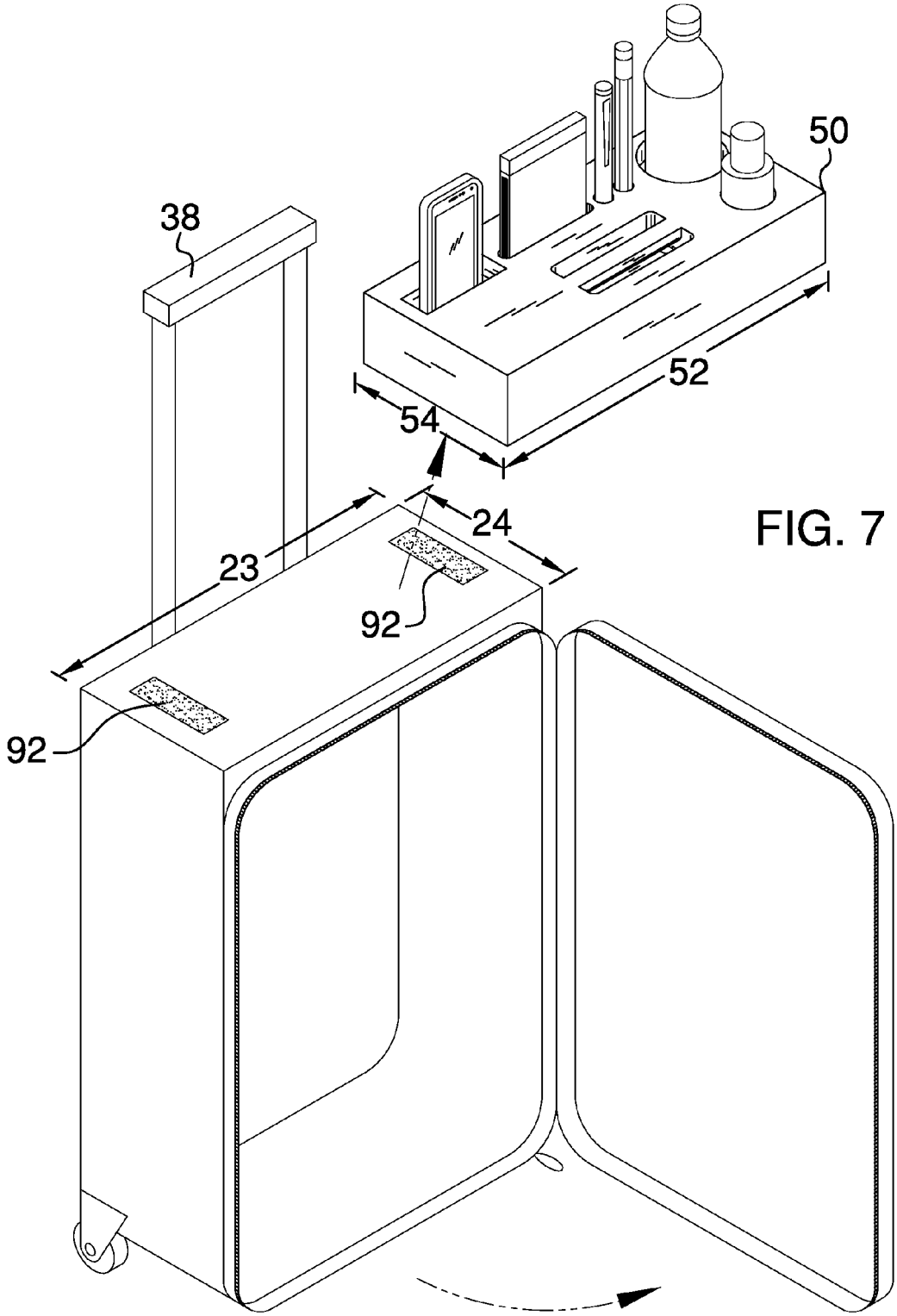
FIG. 7 is an in use perspective view of the organizer case removed from the suitcase travel organizer.
Figure 8:
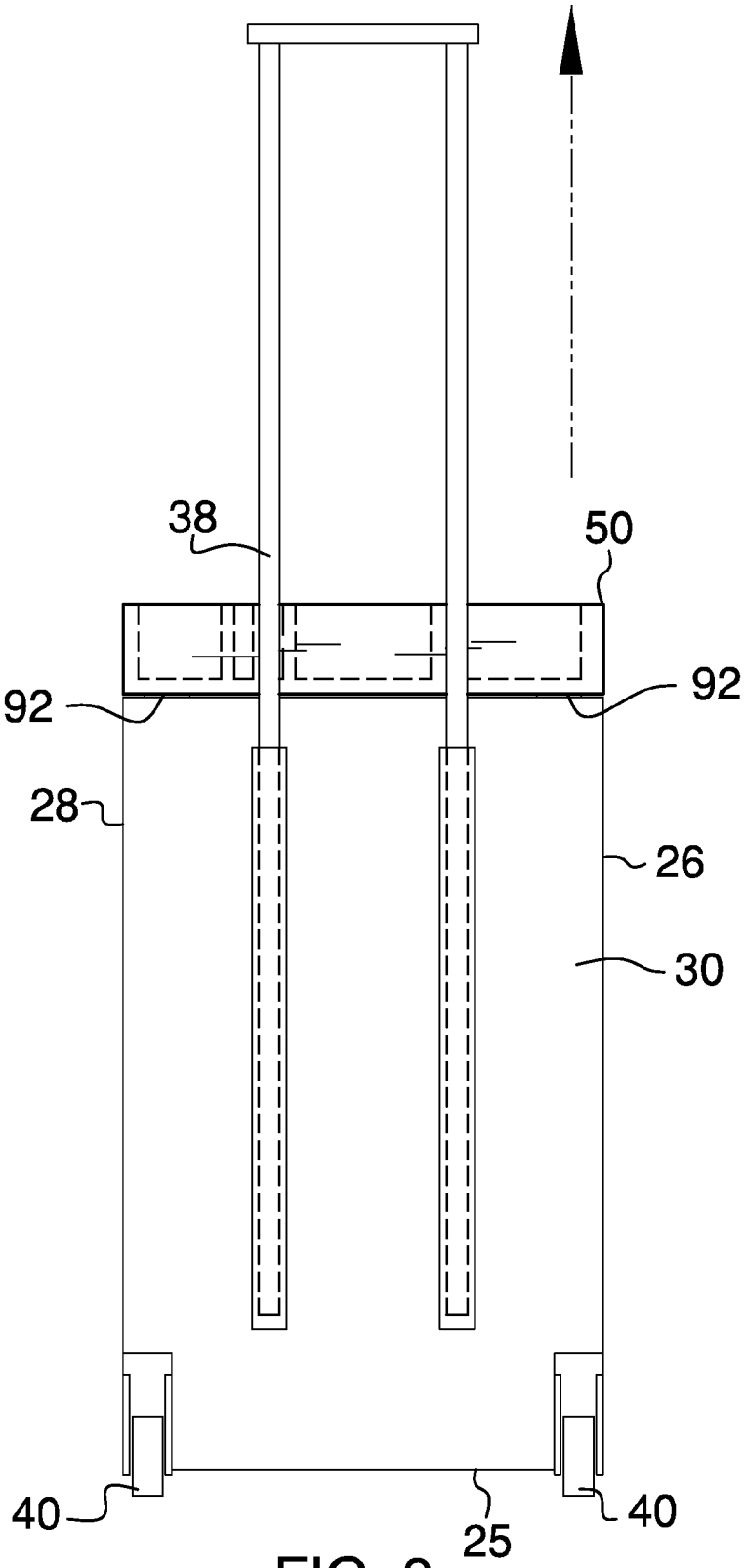
FIG. 8 is back side elevation view.

With reference now to the drawings, and in particular FIGS. 1 through 8 thereof, an example of the suitcase travel organizer employing the principles and concepts of the present suitcase travel organizer and generally designated by the reference number 10 will be described.

Referring to FIGS. 1 through 8, the suitcase travel organizer 10 has a substantially tetragonal luggage bag 20 having a top end 22 and a bottom end 25 spaced apart from the top end 22. The top end 22 has a top end width 23 and a top end depth 24. The luggage bag 20 has first side 26 and a second side 28 spaced apart from the first side 26. The luggage bag 20 has a back side 30 and an openable front side 32 spaced apart from the back side 30. A telescopic handle 38 is disposed on the back side 30. A pair of spaced apart wheels 40 is disposed on the bottom end 25 adjacent the back side 30.

An organizing case 50 is fitted to the top end 22. The case 50 has a top side 57 and a bottom side 58 spaced apart from the top side 57, a case width 52 equal to the top end width 23 and a case depth 54 equal to the top end depth 24. Within the top side 57 is a small circular opening 60 having a first depth 78 of approximately 1½ inches, a large circular opening 61, and a pair of adjacent writing implement openings 62. The top side 57 also has a pair of writing implement openings 62, a ovular opening 63 and a rectangular opening 65.

A cutout 64 is disposed in the top side 57. A crossbar 66 is disposed across a portion of the cutout 64. The crossbar 66 is parallel with the case width 52 and flush with the top side 57. The cutout 64 selectively supports devices such as existing media players. The cutout 64 is proximal the openable front side 32.

The large circular opening 61, the pair writing implement openings 62, the ovular opening 63, the rectangular opening 65, and the cutout 64 each has a second depth 80 of approximately 3 inches. The organizing case 50 is removably affixed to the top end 22. Hook and loop 92 is bonded to the top end 22 and to the bottom side 58.

What is claimed is:

1. A suitcase travel organizer comprising:

a substantially tetragonal luggage bag having a top end and a bottom end spaced apart from the top end, a top end width, a top end depth, a first side and a second side spaced apart from the first side, a back side and an openable front side spaced apart from the back side;

a handle disposed on the luggage bag;

an organizing case disposed on the top end, the case having a top side and a bottom side spaced apart from the top side, a case width equal to the top end width, a case depth equal to the top end depth;

a plurality of circular openings disposed in the top side, the circular openings comprising a small circular opening having a first depth of approximately 1½ inches, a large circular opening having a diameter greater than a diameter of the small circular opening, a pair of adjacent writing implement openings, wherein each writing implement opening has a diameter configured to secure one of a pen and a pencil in an upright position;

an ovular opening disposed in the top side proximal the back side;

a rectangular opening disposed in the top side proximal the first side;

a cutout disposed in the top side, the cutout having a U-shaped cross-section; and a crossbar disposed across a portion of the cutout, the crossbar being parallel with the case width, the crossbar being flush with the top side;

wherein the cutout is configured to support a personal electronic device.

2. The suitcase travel organizer of claim 1 wherein the cutout is proximal the openable front side.

3. The suitcase travel organizer of claim 1 wherein the large circular opening, each writing implement opening, the ovular opening, the rectangular opening, and the cutout have a second depth of approximately 3 inches.

4. The suitcase travel organizer of claim 2 wherein the large circular opening, each writing implement opening, the ovular opening, the rectangular opening, and the cutout have a second depth of approximately 3 inches.

5. The suitcase travel organizer of claim 1 wherein the organizing case is removably affixed to the top end.

6. The suitcase travel organizer of claim 2 wherein the organizing case is removably affixed to the top end.

7. The suitcase travel organizer of claim 3 wherein the organizing case is removably affixed to the top end.

8. The suitcase travel organizer of claim 4 wherein the organizing case is removably affixed to the top end.

* * * * *